United States Patent [19]

Du Rocher

[11] Patent Number: 4,487,369

[45] Date of Patent: Dec. 11, 1984

[54] ELECTROMAGNETIC FUEL INJECTOR WITH IMPROVED DISCHARGE STRUCTURE

[75] Inventor: Daniel J. Du Rocher, Roseville, Mich.

[73] Assignee: Essex Group, Inc., Fort Wayne, Ind.

[21] Appl. No.: 583,802

[22] Filed: Mar. 2, 1984

Related U.S. Application Data

[63] Continuation of Ser. No. 338,800, Jan. 11, 1982, abandoned.

[51] Int. Cl.[3] ..... B05B 1/34; F02M 51/06

[52] U.S. Cl. ..... 239/488; 239/585

[58] Field of Search ..... 239/488, 533.12, 585, 239/489

[56] References Cited

U.S. PATENT DOCUMENTS

| | | | |
|---|---|---|---|
| 1,738,489 | 12/1929 | Williams | 239/488 X |
| 2,974,881 | 3/1961 | Garday . | |
| 3,049,303 | 8/1962 | Kocher | 239/488 X |
| 3,528,613 | 9/1970 | Berlyn . | |
| 4,030,668 | 6/1977 | Kiwor | 239/585 |
| 4,033,513 | 7/1977 | Long | 239/585 |
| 4,060,199 | 11/1977 | Brüne et al. . | |
| 4,116,389 | 9/1978 | Furtah et al. . | |
| 4,186,883 | 2/1980 | Robling . | |
| 4,192,466 | 3/1980 | Tanasawa et al. . | |
| 4,218,021 | 8/1980 | Palma . | |
| 4,230,273 | 10/1980 | Claxton et al. . | |

FOREIGN PATENT DOCUMENTS 153551 of 1921 United Kingdom ..... 239/533.12

*Primary Examiner*—Andres Kashnikow

*Attorney, Agent, or Firm*—Stephen A. Schneeberger

[57] ABSTRACT

An electromagnetically actuated fuel injector is provided with a discharge region of improved construction. The injector discharge region includes a central flow axis and, sequentially in the downstream direction, a simple metering orifice symmetrical with the axis, and flow patterning structure including a diverging flow director for directing the flow of fuel issuing from the metering orifice radially outward relative to the axis to an annular region about the axis and a converging flow director for directing the fuel radially inward relative to the axis from a position radially outward thereof for direct "transparent" discharge thereafter from the injector. A discrete exit nozzle may be shaped to effect the requisite flow convergence, and the angle of that convergence affects the geometry of the final spray pattern. A swirl disc may be positioned intermediate the other two flow directors. By preselecting the angle at which channels in the swirl disc are skewed to the axis, it is possible to obtain respective ones of a variety of fuel spray patterns ranging from a wide angle hollow cone for an acute angle of tangentiality to a string of fuel droplets substantially along the axis when the swirl channels are substantially parallel the axis. The uppper and lower ends of the swirl disc may be tapered.

1 Claim, 5 Drawing Figures

FIG. 2
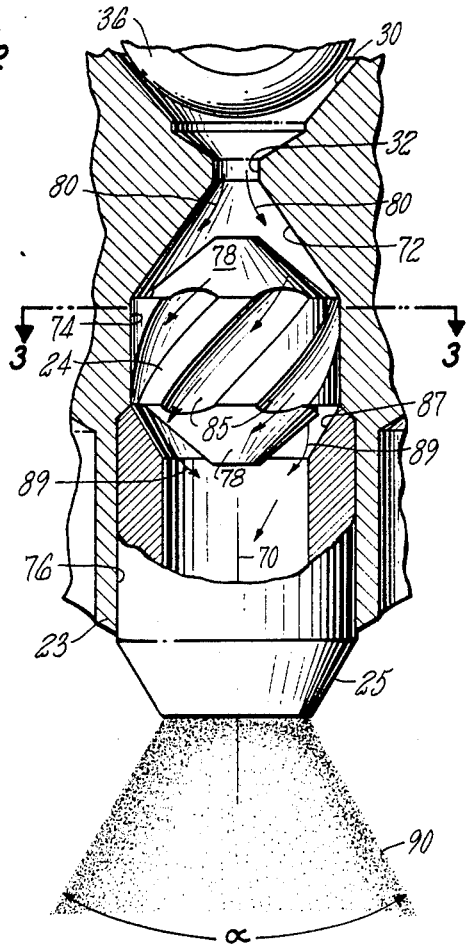
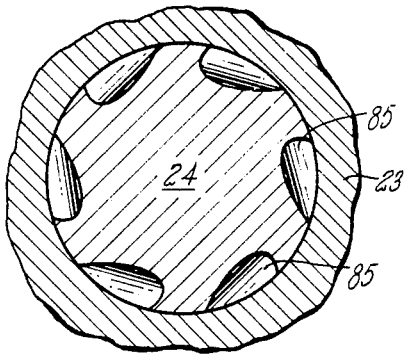
FIG. 3

FIG. 4
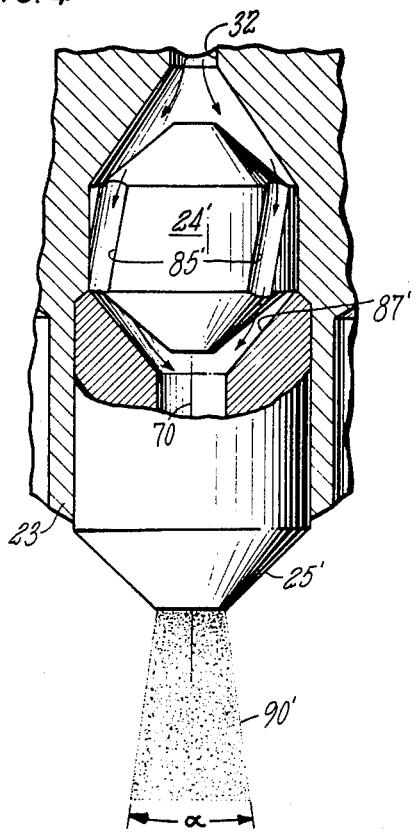
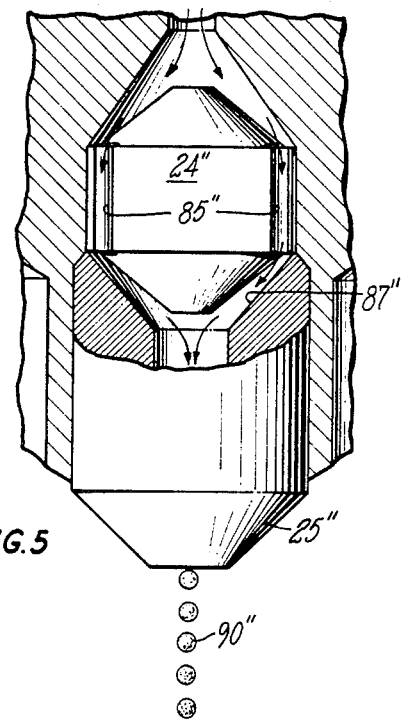
FIG.5

ELECTROMAGNETIC FUEL INJECTOR WITH IMPROVED DISCHARGE STRUCTURE

This is a continuation of Ser. No. 338,800, filed Jan. 11, 1982, abandoned.

DESCRIPTION

1. Technical Field

The invention relates to fuel injectors and more particularly to electromagnetically operated fuel injection valve for internal combustion engines. More particularly still, the invention relates to an improvement in the structure of the discharge region of such fuel injection valves.

2. Background Art

In the quest to improve fuel economy, increase engine operating performance and/or to reduce various emissions from the engine, there has been considerable development of fuel injectors, particularly electromagnetically operated injectors for spark ignited engines. One consideration in the design of such injectors is the pattern of the fuel issuing from the discharge opening of the injector. These patterns often must differ as a function of the location of the injector on and in the engine. In many instances, a relatively broad-angle hollow, conical fuel spray is desired. In yet other instances, the desired fuel spray pattern comprises a relatively narrow-angle solid cone. In yet other applications, the desired fuel injection pattern is a serial string or chain of droplets. Generally speaking, the provision of these widely different spray patterns has required relatively significant changes in the structural design of the discharge region of the injector. Such changes in design are typically expensive to implement.

Moreover, in providing particular configurations to the fuel spray pattern discharged by the injector, it is often common to provide for swirling the fuel prior to its final exit from the injector to enhance atomization. The structure for creating that swirling effect may be located upstream or downstream of the valve and valve seat. Further still, a metering orifice may be provided downstream of the valve for constantly metering the quantity of fuel discharged while the valve is open. The inclusion or non-inclusion of a metering orifice in addition to the valve, the positioning of that orifice, the inclusion or non-inclusion of swirling means and the positioning of such swirling means comprise variables which have existed in certain different combinations, as illustrated by U.S. Pat. Nos. 2,974,881 to Garday, 4,030,668 to Kiwior, 4,033,513 to Long, 4,060,199 to Brune et al, 4,116,389 to Furtah et al and assigned to the assignee of the present invention, 4,186,883 to Robling and assigned to the assignee of the present invention, 4,192,466 to Tanasawa et al, 4,218,021 to Palma and 4,230,273 to Claxton et al. While the injectors of each of the aforementioned patents may be well suited to accomplishing certain design criteria, they do not readily suit the need for a relatively economical electromagnetically actuated fuel injector which traps but a minimum of fuel following valve closure and which may be relatively simply and economically modified to provide a wide range of fuel spray patterns.

Accordingly, it is a principal object of the present invention to provide an improved electromagnetically actuated fuel injector in which the construction of the discharge region minimizes the trapping of fuel and provides for the relatively simple and economical adoption of a variety of widely differing fuel spray patterns.

In accordance with the present invention, there is provided an electromagnetically actuated fuel injector which includes a housing having a flow passage therethrough including an inlet region and a discharge region. A valve seat and a valve are positioned within the flow passage. An armature is operatively connected to the valve and an electromagnetic actuator is controllable to move the armature and thus the valve, between open and closed positions relative to the valve seat. Fuel under pressure passes through the valve when it is opened and subsequently passes through the discharge region downstream thereof where it is discharged from the housing. The discharge region of the injector is of improved construction and includes a central flow axis and, sequentially in the downstream direction, a simple metering orifice symmetrical with the axis, and flow patterning structure including a diverging flow director for directing the flow of fuel issuing from the metering orifice radially outward relative to the axis to an annular region about the axis and a converging flow director for directing the fuel radially inward relative to the axis from a position radially outward thereof for direct "transparent" discharge thereafter from the injector. As used above and subsequently herein, "transparent" means without significant subsequent pressure drop. A discrete exit nozzle may be shaped to effect the requisite flow convergence, and the angle of that convergence affects the geometry of the final spray pattern.

A third flow-directing element may conveniently be provided intermediate the other two flow directors to further control development of the issuing fuel pattern, as for instance to enhance atomization of the fuel. That element may be a cylindrical disc member having a plurality of channels in the circumference thereof, typically for imparting a swirl to the fuel. By preselecting the angle at which the channels in the swirl disc are skewed to the axis, it is possible to obtain respective ones of a variety of fuel spray patterns ranging from a wide angle hollow cone for an acute angle of tangentiality to a string of fuel droplets substantially along the axis when the swirl channels are substantially parallel the axis and impart no swirl. The upper end of the swirl disc may be conically tapered to provide diverging flow director, and the other end of the disc may be similarly tapered to facilitate manufacture and assembly.

BRIEF DESCRIPTION OF THE DRAWINGS

FIG. 2 is an enlarged partial view of FIG. 1 showing the discharge region of the injector in greater detail and with a particular structural geometry which provides a particular spray pattern;

FIG. 3 is a sectional view of the swirl plug taken along line 3—3 of FIG. 2;

FIG. 4 is a sectional view similar to FIG. 2 in which certain changes in structural geometry produce a changed spray pattern; and FIG. 5 is a view similar to FIG. 4 in which the structural geometry is changed still further to create an extreme flow pattern.

BEST MODE FOR CARRYING OUT THE INVENTION

Figure 1:
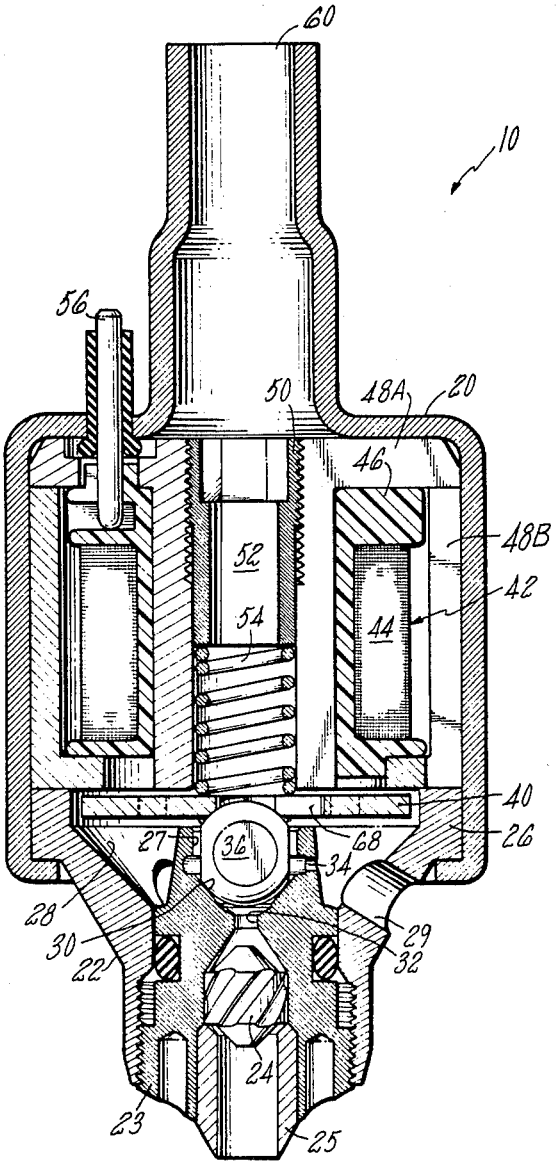
FIG. 1 is an elevational sectional view of an improved electromagnetically actuated fuel injector in accordance with the invention.

Referring to FIG. 1, there is illustrated an elevational sectional view of an electromagnetically actuated fuel injector 10 in accordance with the present invention. A generally elongated tubular housing is provided by a tubular housing member 20 of non-magnetic material, a valve container ring 22 and a valve body assembly comprised of a valve body 23, a swirl disc 24 and an exit nozzle 25. The housing member 20 comprises the upper portion of the injector housing, with the lower remaining portion being formed by valve container ring 22 and the valve body assembly. The housing member 20 includes a lower portion of relatively large diameter and an upper portion of relatively smaller diameter. The lower end of housing member 20 is deformed inwardly to provide an upwardly facing flange which engages a downwardly facing shoulder on an annular rim 26 of the valve container ring 22 to axially retain the container ring.

The diameter of the annular ring 26 of ring 22 is sized for close-fitting insertion into the housing member 20. A first conically-inwardly tapered section of container ring 22 depends from ring 26, followed by a second lower substantially cylindrical section.

The valve body 23 is a generally tubular member which is threadedly inserted into and retained within the lower cylindrical section of the valve container ring 22. The valve body 23 includes an upper portion which extends within the conically-walled section of the valve container ring 22 and spaced relation therewith to form an annular fuel chamber 28 therebetween. One or more ports 29 extend through the conical wall of valve container ring 22 to provide an inlet opening to the fuel chamber 28 of injector 10 from a source of pressurized fuel (not shown) such as gasoline.

The upper portion of the valve body 23 includes a machined central opening which is cylindrical at its upper end 27 and is tapered conically inward therebelow to form an annular valve-seating surface 30 and, further below, includes a cylindrical metering orifice 32 of relatively small diameter. This central opening in valve body 23 extends through the length thereof and, below metering orifice 32, opens to a larger diameter in which a disc 24 is installed for imparting a directional component, typically tangential to produce a swirl, to the flow of fluid therethrough. The swirl disc 24 may be press-fitted into the central opening or may be retained therein by a tubular exit nozzle 25 press-fitted into the opening. The exit nozzle 25 provides the final discharge outlet from the injector for fuel being injected into the engine. This region downstream from the valve seat 30 to the discharge opening of the exit nozzle 25 is referred to herein as the discharge region and will be discussed hereinafter in greater detail.

Fuel from reservoir 28 is admitted to the bore 27 within valve body 23 by means of one, or preferably a plurality of, ports 34 extending tangentially or preferably radially through the valve body 23 above the valve seat 30. Fuel may also pass from reservoir 28 into the upper end 27 of the central bore over the upper end of the valve body 23.

A ball valve element 36 is positioned within the uppermost part 27 of the central bore in valve body 23 and cooperates with the valve seating surface 30 to prevent or allow the flow of fuel from reservoir 28 and ports 34 for discharge to the engine via the discharge region downstream thereof.

The ball valve 36 is attached to an armature 40 of magnetic material. The armature 40 is part of an electromagnetic motor or solenoid 42 housed in housing member 20. The solenoid 42 selectively controls the axial positioning of armature 40, and thus the ball valve 36, to open or to allow the closing of the valve, thereby allowing or preventing the discharge of fuel from injector 10 into the engine.

The solenoid 42 includes a wire coil 44 disposed on bobbin 46 which is disposed between the radially inner and outer sections 48A and 48B respectively of an annular magnetic frame. The inner magnetic frame section 48A includes a cylindrical, fluid passing bore 51 extending coaxially therethrough into the top end of which is threadedly inserted a tubular spring adjuster 50 having a fluid passing bore 52 extending coaxially therethrough. A helical compression spring 54 positioned within the central bore of inner magnetic frame 48A applies a downward, or closing, biasing force to the upper surface of armature 40 and thus also to the ball valve 36.

The upper portion of housing member 20 is, in the illustrated embodiment, open at its upper end to provide a return outlet opening 60 from which fuel may be returned to a reservoir and pump, typically via a pressure regulator (not shown). Fuel admitted to the reservoir 28 via inlet opening 29 is able to continuously pass upwardly through and around the armature 40 via various openings 68 extending axially therethrough, and thence through the central bore 51 and out through the return outlet opening 60. Although this flow path is not necessarily present in all injectors, in most instances the armature 40 and ball valve 36 will be continuously immersed in fuel. The other flow path in the system is, of course, the valved flow path from reservoir 28 which extends past the valve seat 30, and through the discharge region of the injector for injection to the engine.

The coil 44 is attached to a pair of terminals 56 (only one being shown). Application and removal of an appropriate electrical potential to the terminals 56 operates in a known manner to actuate the armature 40 and ball valve 36 and thus open or close the valve.

In accordance with the invention, the discharge region of injector 10, and specifically that region of the valved flow path downstream of valve seat 30 is of a construction which minimizes trapped fuel upon valve closing and is of a relatively simple but versatile construction which minimizes the cost and complexity of affording a relatively wide range of fuel spray patterns by the substitution of but a few easily manufactured components.

Referring to FIG. 2 for a more detailed consideration of the discharge region of the valve flow path, it will be noted that the metering orifice 32 is a single, small diameter opening concentric with the central flow axis 70 of the discharge region. Metering orifice 32 is positioned in close proximity with the region of contact of ball valve 36 with seating surface 30 so as to minimize the volume therebetween in which fuel may be trapped following closure of the valve. In accordance with the invention, the area of metering orifice 32 normal to the direction of flow thereat will be equal to, or preferably less than, the smallest cumulative area of the flow path normal to the direction of flow anywhere downstream thereof in the discharge region. Such dimensioning enables the metering orifice 32 to be the final metering element. It will be understood that additional metering may occur upstream of metering orifice 32, as for instance at the valve and valve seat region.

Downstream of the metering orifice 32, the central opening in valve body 23 gradually increases in diameter along a truncated conical zone 72 of the opening in which divergence of the flow occurs. The flow diverging zone 72 is followed by a generally cylindrical section 74 in which the swirl disc 24 is positioned. The final downstream section 76 of the opening in valve body 23 is elongated and cylindrical, and receives exit nozzle 25 which includes a flow-converging surface 87. In accordance with the invention, the flow of fuel issuing from metering orifice 32 is first caused to radially diverge within diverging zone 72 and is subsequently caused to radially converge in the converging region 87 of exit nozzle 25 for discharge from the injector. The axially opposite ends of swirl disc 24 are each provided with integrally formed conical extensions 78 such that the disc member 24 is symmetrical about a plane transverse to the central flow axis 70 and is thus capable of installation in section 74 of the bore in either orientation, thereby facilitating assembly.

More particularly, the conical extension 78 extending in the upstream direction aids in diverging the fuel flow as it issues from metering orifice 32, as represented by flow direction arrows 80. This flow diverges to an annular region having its outer diameter defined by the axial section 74 of the central bore. The cross-sectional area of flow path 80 normal to the direction of flow is somewhat greater than at metering orifice 32 and remains substantially constant throughout the diverging zone 72 of the bore.

The disc 24 is positioned in the axial section 74 of the central bore and substantially occludes the cross section of that bore except for one, or preferably a plurality, of grooves or channels 85 extending generally axially along the periphery of the plug in that region. Grooves 85 provide liquid communication between the diverging region 72 of the bore and the converging region 87 therebelow at the upper end of the exit nozzle 25. The grooves 85 may, in an extreme instance depicted in FIG. 5, be formed to extend parallel to the central flow axis 70. However, it will be desirable in the instance of most different fuel spray patterns to impart a swirl to the fuel as it passes through this region 74 and accordingly, the longitudinal axes of the respective grooves 85 are skewed relative to the central flow axis 70 to provide a generally tangential component to the flow. The cumulative cross-sectional area of the grooves 85 is preferably as great as that existing in the divergent zone 72 so the flow is not unduly restricted. More specifically, in the illustrated embodiment that area is substantially the same as that in the diverging zone 72.

Fuel issuing from disc grooves 85 is then converged, placing some portion of the fluid in shear and thereby enhancing atomization of the fuel. This convergence of the fuel stream is obtained by a downwardly and inwardly beveled converging surface 87 near the upper end of the exit nozzle 25. The converging surface 87 is of truncated conical form, its larger diameter base being of substantially the same diameter as an being adjacent to the lower end of zone 74, and its smaller diameter being positioned downstream thereof and corresponding with the inside diameter of the remainder of exit nozzle 25. The full or included angle of the converging wall 87 bisected by flow axis 70 may be in the range of about 15°–120°, and typically in the range of 60°–80°. The diameter of the base of the conical extension 78 at the underside of swirl disc 24 is sufficiently small and the included angle of that cone is sufficiently large that the annular region of convergent fuel flow defined by it and the converging surface 87, and represented by flow arrows 89, do not restrict the flow of fuel issuing therefrom. Similarly, the inner diameter of exit nozzle 25 is sufficiently large that it does not impede or restrict the flow of fuel issuing therefrom. Thus it may be said that the discharge region downstream of metering orifice 32 is "transparent" to the flow of fuel therethrough. The length of exit flow nozzle 25 will typically be about 7 millimeters and its inner diameter will be in the range of 1–4.5 millimeters, depending upon the fuel spray pattern desired.

In the embodiment illustrated in FIGS. 1, 2 and 3, the fuel spray pattern 90 issuing from injector 10 is in the general form of a hollow cone having an included angle, $\alpha$, of about 60°. For a given set of flow and pressure conditions at and upstream of the metering orifice 32, the geometry of the flow patterning structure which provides this pattern includes the diverging cone 78 on swirl disc 24 having an included angle of 100°, the swirl disc 24 having six flow grooves or channels 85 each skewed at an angle of 45° to the central flow axis 70, the flow converging surface 87 having an included angle of 60° and the internal diameter of exit nozzle 25 being about 3 millimeters.

Referring to FIG. 4, the geometry of two elements of the flow-patterning structure of the injector has been modified somewhat to provide a significantly different fuel spray pattern 90' having the form of a solid cone with an included angle, $\alpha$, of about 15°. The modified components in this embodiment are designated by primed reference numerals and include the swirl channels or grooves 85' in swirl disc 24' being skewed at an angle of about 10° to the central flow axis 70. Additionally, the included angle defined by the convergence surface 87' is about 80° and the inner diameter of exit nozzle 25' is about 1.2 millimeters.

FIG. 5 illustrates an embodiment of yet another variation in the geometry of the flow-patterning structure of injector 10, those elements which are modified being designated by reference numerals bearing double-primed superscripts. This embodiment represents a limit or extreme condition in which the fuel spray pattern 90'' is in the form of a serial string of droplets or a so-called "string of pearls", as may be required for certain engine applications. This fuel pattern is obtained principally by orienting the flow channels 85'' in swirl disc 24'' such that they impart little or no tangential or radial component to the fuel flowing therethrough. In this instance, the axial dimension of the cylindrical portion of disc 24'' may be reduced to a minimum. Three grooves 85'' are provided in disc 24''. Additionally, the included angle of the converging surface 87'' of exit nozzle 25'' is approximately 80°, and the inside diameter of exit nozzle 25'' is about 1.5 millimeters.

In view of the foregoing description, it will be appreciated that the structuring of the injector discharge region, and particularly the flow-patterning elements thereof, in accordance with the invention affords the ability to fabricate injectors having a variety of differing fuel spray patterns with the substitution of only two components having the requisite modifications therein. In some instances, it may be desirable to modify the diameter of metering orifice 32 somewhat, usually to change the rate of fuel injection, however, this modification is easily accomplished during the machining of that orifice. Moreover, the sequence in which the components of the discharge region of the injector are arranged serves to minimize the volume of fuel trapped downstream of the valve seat and facilitates the transparent discharge of fuel issuing from the metering orifice.

Although this invention has been shown and described with respect to detailed embodiments thereof, it will be understood by those skilled in the art that various changes in form and detail thereof may be made without departing from the spirit and scope of the claimed invention.

I claim:

1. In an electromagnetic fuel injector including a housing having a flow passage therethrough including an inlet region and a discharge region having a central flow axis, said housing including a tubular opening coaxial with said central flow axis in the discharge region thereof, a valve seat and a valve in said flow passage, electromagnetic actuating means, armature means cooperating with said valve and responsive to energization and deenergization of said electromagnetic actuating means for moving said valve between open and closed positions relative to the valve seat and wherein, when said valve is open, fuel admitted under pressure to said housing inlet region upstream of said valve flows between said valve and said valve seat and through the discharge region downstream thereof where it is discharged from the housing, the improvement wherein:

said flow passage discharge region includes sequentially in the downstream direction, a circular metering orifice coaxial with the axis and transparent flow patterning means, the area of said metering orifice normal to the direction of flow being at least as small as the smallest cumulative area of the flow path anywhere downstream thereof in said discharge region, said flow patterning means including first, second and third flow directing means sequentially in the downstream direction, said second flow directing means comprising a cylindrical disc member having a plurality of discrete flow channels extending generally helically in the circumference thereof, each said flow channel having an inlet and having an outlet oriented to direct the flow issuing therefrom at a predetermined skew angle relative to the axis, said housing opening including a cylindrical section and said disc member being positioned in said cylindrical section of said housing opening to occlude fuel flow except through said channels, said disc member being tapered conically at its upstream end to provide said first flow directing means for directing said flow radially outward relative to the axis to the inlets of said disc member flow channels, the cross-sectional area of the flow path along said first flow directing means and normal to the direction of flow being substantially constant, said tubular opening in said housing means being elongated and including a cylindrical exit nozzle inserted thereinto coaxially with the central flow axis, said third flow directing means comprising an annular inclined surface on said exit nozzle to direct fuel issuing from said disc member flow channel outlets radially inward relative to the axis for direct discharge thereafter from the injector, said disc member being additionally conically tapered at its downstream end so as to be symmetrical about a plane normal to the axis to facilitate assembly.

* * * * *